United States Patent [19]

Isozumi

[11] Patent Number: 5,028,805

[45] Date of Patent: Jul. 2, 1991

[54] STARTER DEVICE

[75] Inventor: Shuzoo Isozumi, Himeji, Japan

[73] Assignee: Mitsubishi Denki K. K., Tokyo, Japan

[21] Appl. No.: 366,716

[22] Filed: Jun. 15, 1989

[30] Foreign Application Priority Data

Jul. 12, 1988 [JP] Japan ..... 63-174035

[51] Int. Cl.[5] ..... F02N 11/00

[52] U.S. Cl. ..... 290/48; 290/52

[58] Field of Search ..... 74/6, 7 R, 7 A, 7 B; 290/48

[56] References Cited

U.S. PATENT DOCUMENTS

| | | | |
|---|---|---|---|
| 1,246,057 | 11/1917 | Conrad et al. | 74/6 |
| 4,404,533 | 9/1983 | Kurihara et al. | 335/131 |
| 4,440,033 | 4/1984 | Kurihara et al. | 74/7 A |
| 4,613,761 | 8/1986 | Yabunaka | 290/36 R |

FOREIGN PATENT DOCUMENTS

| | | | |
|---|---|---|---|
| 903051 | 7/1949 | Fed. Rep. of Germany | 74/7 A |

*Primary Examiner*—J. R. Scott
*Assistant Examiner*—Robert L. Hoover
*Attorney, Agent, or Firm*—Sughrue, Mion, Zinn, Macpeak & Seas

[57] ABSTRACT

In a starter device of a type having a tubular rotary output shaft is in alignment with the armature shaft of a d.c. motor, and a tubular pinion moving shaft which has a pinion to be meshed with the ring gear of an automobile engine at its one end and receives therein the rotary output shaft, is connectable to the armature shaft by means of an overrunning clutch, the rotary output shaft is a tubular shaft and a movable shaft is disposed in the tubular rotary output shaft so as to be movable in the axial direction in association with the tubular pinion moving shaft, wherein the movable shaft has a stopper which is brought into contact with an immovable part which does not move in at least the axial direction of the starter device when the movable shaft is moved by a predetermined distance.

2 Claims, 3 Drawing Sheets

STARTER DEVICE

BACKGROUND OF THE INVENTION

1. Field of the Invention

The present invention relates to a starter device. More particularly, it relates to a starter device to start an automobile engine.

2. Discussion of Background

A known overhang type starter device is shown in FIG. 3, wherein a passage or opening 2 is formed in a front machine frame 1; a bearing 3 is fitted to the front machine frame 1 at a position inside the opening 2 and slidably supports a tubular pinion shaft; a rotary output shaft 4 is inserted as a supporting shaft in the tubular pinion shaft 5, and a pinion 5*a* is formed at the outer circumferential part of the front end of the pinion shaft 5 so that the pinion is engaged with a ring gear (not shown) of an engine when the pinion shaft is extended from the opening 2.

In FIG. 3, a d.c. motor 7 has an armature rotary shaft 6. A sun and planet gear speed reducing device 8 is provided with a plurality of planet gears 8*b* meshed with a sun gear 8*a* formed in the armature rotary shaft 6 so that a revolution speed of the rotary shaft 4 is reduced. A rotary output shaft 4 is disposed on the same axial line of the armature rotary shaft 6. One end of the rotary output shaft 64 constitutes a carrier 8*c* for the planet gear speed reducing device 8 and the other end is extended to the opening 2 of the front machine frame 1.

An overrunning clutch 9 is slidable on the rotary output shaft 4, which comprises a clutch outer member 9*a* meshed with a helical spline 4*a* formed on the rotary output shaft 4 and a clutch inner member 9*b* constituted by the rear end portion of a tubular pinion shaft 5. A rear bracket 10 is attached to the rear end portion of the yoke 7*a* of the d.c. motor 7. An electromagnetic switch 11 is mounted on the d.c. motor and attached to the upper part of the front machine frame 1. The electromagnetic switch 11 comprises an exciting coil 12 wound on a bobbin, a plunger 14 as a movable iron core, a rod 15 disposed in an insertion hole formed at the central portion of a fixed iron core 13 and extending toward the plunger 14, a movable contact 16 supported by the rod 15, a fixed contact 17, a return spring 18 interposed between the fixed iron core 13 and the plunger 14, and a hook 19 disposed in a recess formed in the plunger 14.

A shift lever 20 is pivotally supported in the front 25 machine frame 1 and has one end engaged with a retaining portion 19*a* of the hook 19 and the other end which is engaged with an annular member 21 attached to the clutch outer member 9*a* of the overrunning clutch 9. A numeral 22 designates a compression spring to apply a pushing force to the hook 19 so that a pinion 5*a* formed in the pinion moving shaft is engaged with the ring gear of the engine by means of the shift lever 20.

In the conventional starter device, a stopper 23 is fixed at the outer circumferential part of the front end (at the right side in FIG. 3) of the rotary output shaft 4. Further, an enlarged inner diameter portion 5*b* is formed at the front end of the tubular pinion moving shaft along a predetermined length in its axial direction, the length corresponding to the moving distance of the tubular pinion shaft 5. Accordingly, when the pinion shaft 5 is moved forwardly by the shift lever 20, a step portion 5*c* formed at the left of the enlarged inner diameter portion 5*b* of the pinion moving shaft 5 is brought to contact with the stopper 23 at a predermined position, i.e. the position where the pinion 5*a* is meshed with the ring gear of the engine, whereby the pinion shaft 5 is stopped. Thus, the entire length of the starter device can be shortened by forming the enlarged inner diameter portion 5*b* at the front end of the tubular pinion moving shaft 5 so that the stopper 23 is relatively moved in the large diameter portion 5*b* when the pinion moving shaft 5 is forwardly moved until the step portion 5*c* is brought to contact with the stopper 23.

In the conventional starter device having the construction decscribed above, the enlarged inner diameter portion 5*b* formed at the front end of the tubular pinion moving shaft 5 reduces the thickness of the bottom land of the pinion 5*a*. The reduced thickness of the bottom land causes limitations in the size and the number of teeth of the pinion 5*a*. In other words, the bottom land of the pinion 5*a* has to be sufficiently thick in order to maintain a sufficient strength of the pinion 5*a*. Accordingly, the size and the number of the teeth of the pinion has to be within the minimum requirements, and there is limitation with respect to the gear ratio of the pinion to the ring gear of the engine, whereby flexibility in designing the starter device is small. The electromagnetic switch in the conventional starter device is so constructed that the return spring 18 is interposed in a compressed state between the plunger 14 and the circumferential portion of the fixed iron core 13 so that the tubular pinion moving shaft 5 is returned to the retracted position by means of the shift lever 20. Accordingly, the cross-sectional surface area constituting a magnetic path is reduced to thereby reduce a magnetic attractive force of the plunger is reduced.

SUMMARY OF THE INVENTION

It is an object of the present invention to provide a starter device to increase design flexibility by expanding the lower limit of the size and the number of teeth of the pinion. It is another object of the present invention to provide a starter device to increase a magnetic attractive force to the plunger while keeping the original magnetic cross-sectional surface area in the electromagnetic switch.

In accordance with the present invention, there is provided a starter device which comprises a d.c. motor having an armature shaft, a rotary output shaft arranged in alignment with the armature shaft, a planet gear speed reducing device adapted to engage the rotary output shaft with the armature shaft so as to transmit a torque of the armature shaft to the rotary output shaft, an electromagnetic switch mounted on the d.c. motor, a tubular pinion shaft for receiving therein the rotary output shaft and slidable along the axial line of the same, the tubular pinion shaft having the front end part provided with a pinion engageable with the ring gear of an engine at the outer circumferential part, wherein the rotary output shaft is a tubular shaft, and a movable shaft is disposed in the tubular rotary output shaft so as to be movable in the axial direction in association with the tubular pinion shaft, the movable shaft having a stopper which is brought into contact with an immovable part which does not move in at least the axial direction of the starter device when the movable shaft is moved by a predetermined distance.

Further, in accordance with the present invention, there is provided a shift lever to move the tubular pinion moving shaft, one end of the shift lever being connected to a hook attached to the plunger of the electromagnetic switch and the other end being connected to the tubular pinion moving shaft, the rotary output shaft is a tubular shaft; a movable shaft is disposed in the tubular rotary output shaft so as to be movable in the axial direction in association with the tubular pinion moving shaft, the movable shaft having a stopper which is brought into contact with an immovable part which does not move in at least the axial direction of the starter device when the movable shaft is moved by the predetermined distance, and a spring means is interposed between the movable shaft and the immovable part to return the movable shaft to the retracted position.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
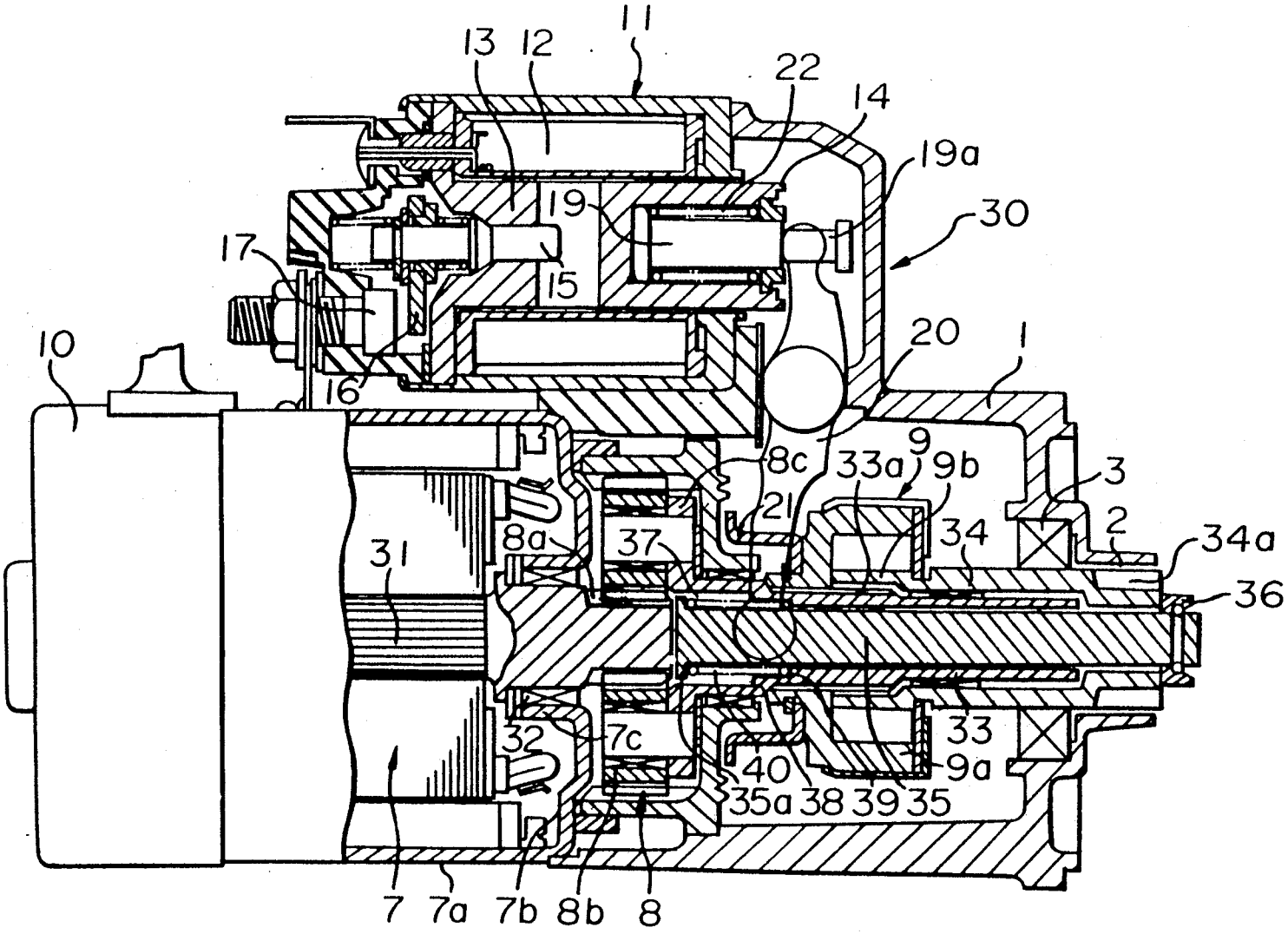
FIG. 1 is a longitudinal cross-sectional view of an embodiment of the starter device according to the present invention.

Referring to the drawings, wherein the same reference numerals designate the same or corresponding parts throughout the several views, and more particularly to FIG. 1 thereof, there is shown a longitudinal cross-sectional view of an embodiment of the starter device of the present invention. In FIG. 1, reference numeral 30 designates a starter device of the present invention in which the front end of the armature rotary shaft 31 of the d.c. motor 7 terminates at an end of the sun gear **8*a* meshed with the planet gear 8*b* of the planet gear speed reducing device 8, and is rotatably supported by a bearing 32 fitted to a bearing supporter 7*c* in a tubular form which is formed at the central portion of an intermediate bracket 7*b* which is formed integrally with the yoke 7*a*. A rotary output shaft 33 is formed in a tubular form and has its one end (the rear end) where the carrier 8*c* for the planet gear speed reducing device 8 is formed. A helical spline 33*a* is formed at the outer circumferential portion of the intermediate section of the tubular rotary output shaft 33 so that it is meshed with the clutch outer member 9*a* of the overrunning clutch 9. The other end (the front end) of the rotary output shaft 33 terminates a position slightly behind a pinion 34*a* formed at the outer circumferential portion of the front end of the tubular shaft 34. A movable shaft 35 is disposed in a slidable manner in the inner passage of the tubular rotary output shaft 33. The front end of the movable shaft 35 projects from the tubular pinion shaft 34 at its retracted position, and a stop ring 36 is attached to the end portion of the pinion moving shaft 34. The rear end of the movable shaft 35 terminates at a position closely facing an end of the armature rotary shaft 31 as shown in FIG. 1, and the rear end is provided with a flange-like projection radially projecting which constitutes a stopper 35*a*. At the rear side of the inner passage of the rotary output shaft 33, there is formed an enlarged inner diameter portion 37 which allows the stopper 35*a* formed at the rear end of the movable shaft 35 to move forwardly in its axial direction for a predetermined distance. A step portion 38 or a small diameter portion 38 is formed in the enlarged inner diameter portion 37 so that the movable shaft 35 is stopped by hitting the stopper 35*a* to the step portion 38. A recess having an inner diameter smaller than the step portion 38 is formed at the innermost portion in the inner passage of the, rotary output shaft 33, which is further extended toward the front side of the shaft 33 beyond the step portion 38. A return spring 40 in a coil form is interposed between the bottom wall 39 of the recess and the stopper 35*a* of the movable shaft 35**.

Figure 3:
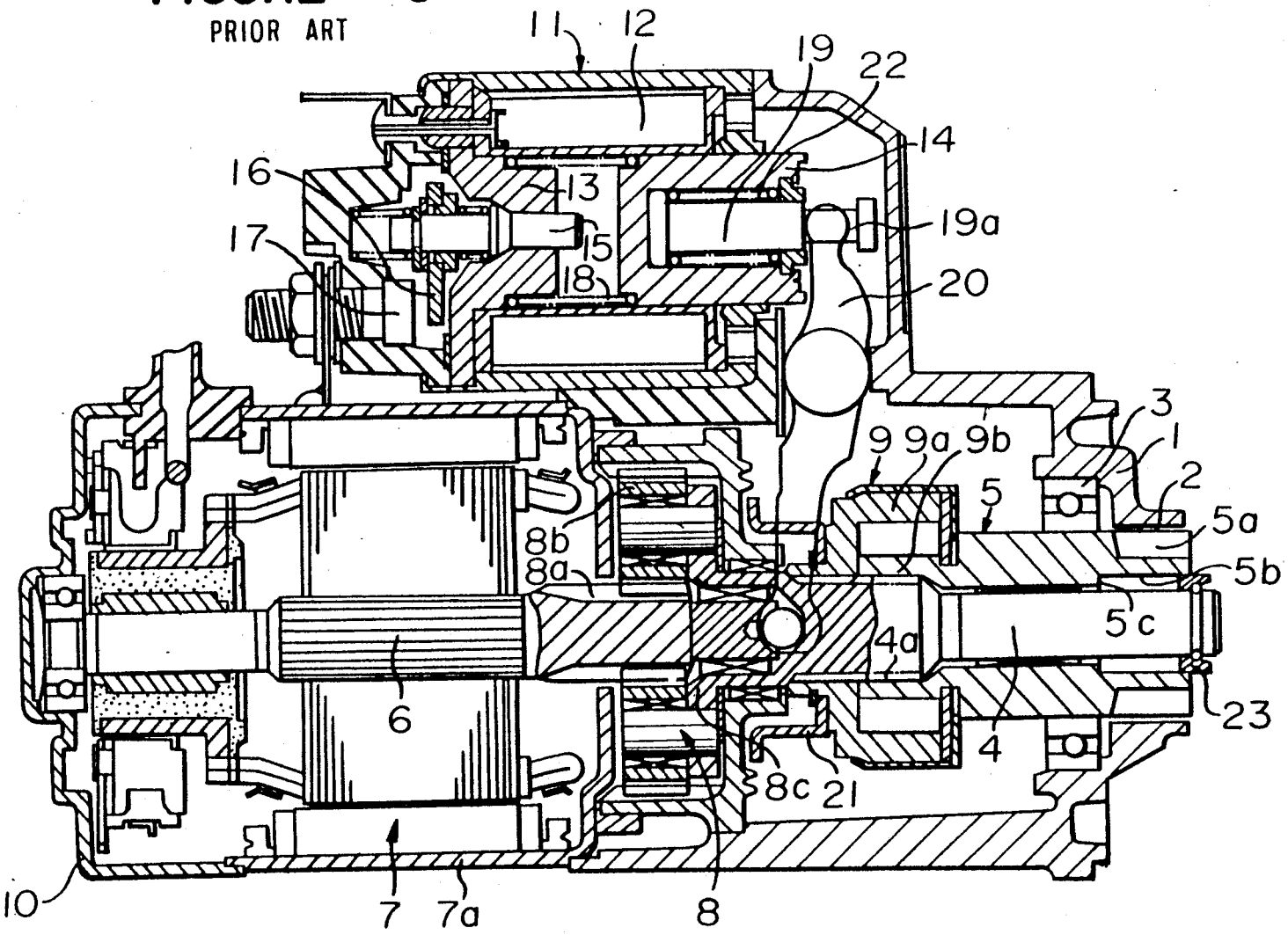
FIGURE 3 PRIOR ART
FIG. 3 is a longitudinal cross-sectional view showing a conventional starter device.

An electromagnetic switch 11 has the same construction as that of the conventional starter device as shown in FIG. 3 except that the return spring 18 is eliminated.

The operation of the starter device 30 as shown in FIG. 1 will be described.

When a key switch is operated to start the engine of an automobile, the electromagnetic switch 11 is supplied with a current so that the plunger, 14 is attracted. This causes the shift lever 20 to be turned about the pivotal shaft, whereby the tubular pinion shaft 34 is moved forwardly on the rotary output shaft 33 together with the overrunning clutch 9. In this case, the movable shaft 35 is drawn from the inner passage of the rotary output shaft 33 and is moved forwardly since the front end of the tubular pinion moving shaft 34 is in contact with the stop ring 36 attached to the front end of the movable shaft 35. The return spring 40 is compressed by the forward movement of the movable shaft 35, and when the tubular pinion moving shaft 34 comes to a position where the pinion **34*a* is entirely meshed with the ring gear of the engine, the stopper 35*a* at the rear end of the movable shaft 35 is brought to contact with the step portion 38, whereby the pinion moving shaft 34** is stopped.

Then, the key switch is disconnected as soon as the engine is started to thereby stop a current to the electromagnetic switch 11, and a magnetic attractive force to the plunger 14 is released. As a result, a force forwardly urging the pinion moving shaft 34 and the movable shaft 35, which is applied by means of the shift lever 20, is released, whereby the movable shaft 35 is returned to the retracted portion by the action of the return spring 40. Accordingly, the returning movement of the movable shaft 35 moves the pinion moving shaft 34 and the overrunning clutch 9 to the retracted position along the axial direction by means of the stop ring 36. Then, the shift lever 20, which is engaged with the annular member 21 attached to the clutch outer member **9*a* of the overrunning clutch 9 is turned about the pivotal shaft, whereby the plunger 14 of the electromagnetic switch 11 is moved to the original position by means of the hook 19**.

Figure 2:
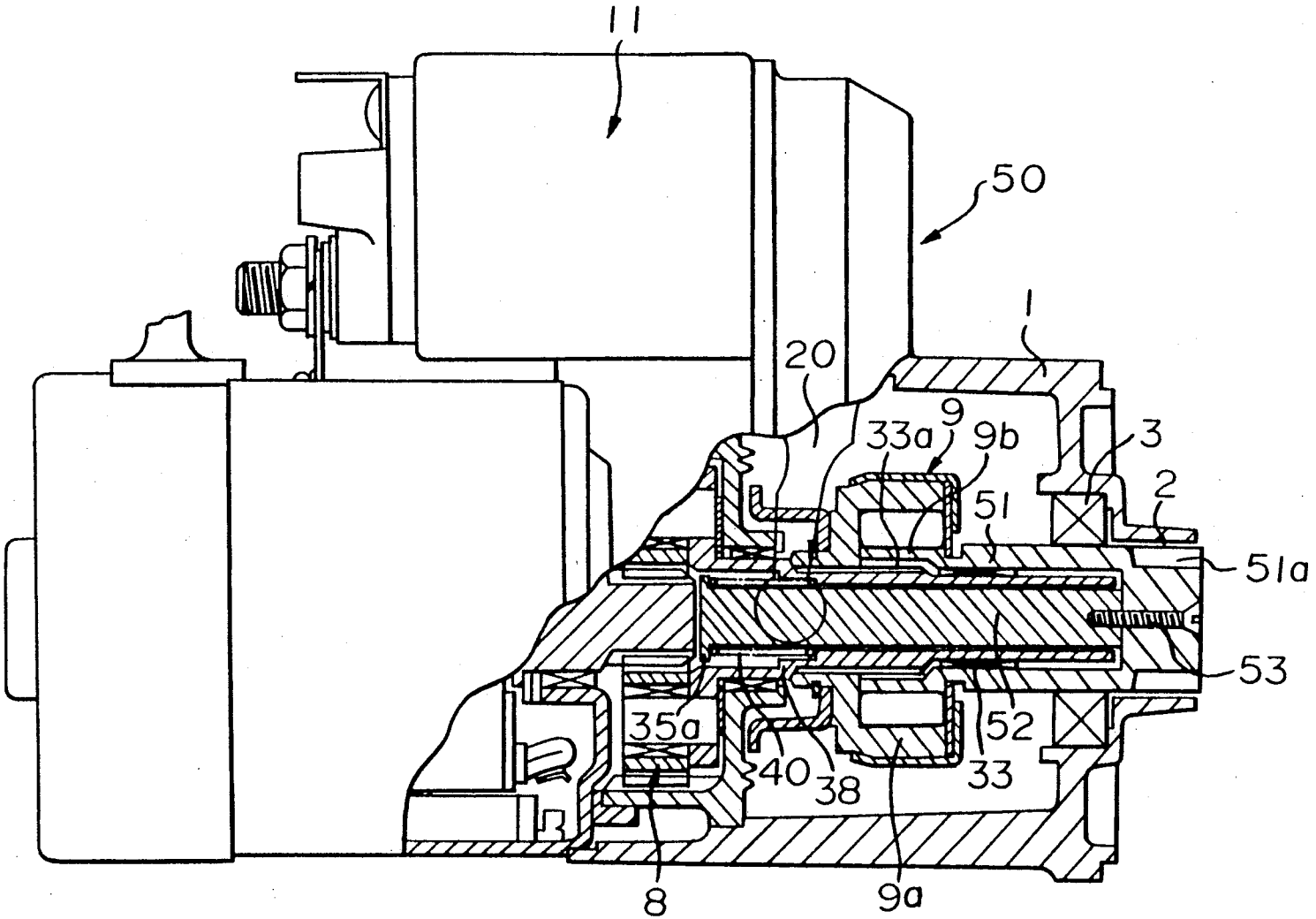
FIG. 2 is a front view partly cross-sectioned of another embodiment of the starter device according to the present invention.

FIG. 2 shows another embodiment of the starter device of the present invention. In this embodiment, the front end of the tubular pinion moving shaft 51 is blind at a portion where a pinion **51*a* is formed. The front end of a movable shaft 52 received in the rotary output shaft 33 in a slidable manner, is in contact with the bottom wall of the closed portion of the pinion moving shaft 51 and is firmly connected by means of a screw 53** threaded from the outer side surface of the closed portion.

The construction of the second embodiment performs the same function and effect as the first embodiment as shown in FIG. 1.

In the second embodiment shown in FIG. 2, various means may be used to connect the pinion moving shaft 51 to the movable shaft 52 other than the screw.

As described above, the embodiments of the present invention are so constructed that the movable shaft 35 disposed in the inner passage of the tubular rotary output shaft 33 is movable in association with the tubular pinion moving shaft 34 by means of the stop ring 36, and the stopper 35*a* to stop the pinion moving shaft 34 at a predetermined position is formed at the rear portion of the movable shaft 35. Accordingly, it is unnecessary to form an enlarged space at the inner diameter portion of the pinion moving shaft 34 so that the stopper enters in the space, and accordingly, the size of the pinion 34*a* can be small or the number of teeth of the pinion can be reduced; thus, flexibility in designing the starter device can be increased.

In the embodiments of the present invention, the return spring 40 is mounted on the stopper 35*a* of the movable shaft 35 to thereby impart a returning force to the movable shaft 35. Accordingly, it is possible to eliminate a return spring which was provided in the electromagnetic switch in the conventional starter device. Therefore, a necessary magnetic cross-sectional surface area can be maintained, and an initial attractive force to the plunger can be increased.

Obviously, numerous modifications and variations of the present invention are possible in light of the above teachings. It is therefore to be understood that within the scope of the appended claims, the invention may be practiced otherwise than as specifically described herein.

What is claimed is:

1. A starter device which comprises:

a d.c. motor having an armature shaft (31), a rotary output shaft (33) arranged in axial alignment with the armature shaft, a sun and planet gear speed reducing device (8) arranged such that a sun gear thereof is disposed at a front end of said armature shaft juxtaposed next to the rotary output shaft, and coupling the armature shaft to he rotary output shaft, an axially-movable overrunning clutch adapted to engage the rotary output shaft with an inner member (9*b*) of the clutch to transmit a torque of the rotary output shaft to the clutch inner member, an electromagnetic switch mounted on the d.c. motor, said clutch inner member having an integral, outwardly directed extension defining a tubular pinion shaft (34) for receiving therein the rotary output shaft and slidable therealong said tubular pinion shaft having an outermost front end part provided with a pinion engageable with a ring gear of an engine, said rotary output shaft being an axially-fixed tubular shaft, with a movable shaft (35) slidably disposed inside said tubular rotary output shaft so as to be movable in he axial direction in association with the tubular pinion shaft, the movable shaft having a stopper (35*a*) which is brought into contact with an immovable part which does not move in at least the axial direction of the starter device when the movable shaft is moved by a predetermined distance, wherein the front end of the movable shaft extends from the front ends of both the tubular pinion shaft and the tubular rotary output shaft, respectively, even when the movable shaft is at a retracted position, and wherein the movable shaft is provided with a stop ring at its front end, said stop ring maintaining abutting contact with the front end of the tubular pinion shaft so as to be axially movable in association with said pinion shaft, and wherein the tubular pinion shaft has a front portion with a reduced inner diameter part which extends between the front end of the rotary output shaft and the sop ring of the movable shaft, the diameter of the reduced diameter part being slightly larger than the outer diameter of the movable shaft such that said reduced diameter part slidably journals a front end portion of the movable shaft, the pinion being formed at the outer diameter part of the tubular pinion shaft and axially rearward from the stop ring.

2. The starter device according to claim 1, wherein the immovable part is a shoulder part formed at an enlarged inner diameter part of an inner rear end portion of the rotary output shaft, and a flange is formed at an inner rear end of the movable shaft.

* * * * *